US006763937B2

(12) United States Patent
Scholz

(10) Patent No.: US 6,763,937 B2
(45) Date of Patent: Jul. 20, 2004

(54) PAINTBOX COMPRISING EXCHANGEABLE PAINT DISHES

(75) Inventor: Günter Scholz, Garbsen (DE)

(73) Assignee: Pelikan PBS-Produktionsgesellschaft mbH & Co. KG, Hannover (DE)

( * ) Notice: Subject to any disclaimer, the term of this patent is extended or adjusted under 35 U.S.C. 154(b) by 125 days.

(21) Appl. No.: 10/168,684

(22) PCT Filed: Dec. 15, 2000

(86) PCT No.: PCT/DE00/04525

§ 371 (c)(1),
(2), (4) Date: Jun. 21, 2002

(87) PCT Pub. No.: WO01/47727

PCT Pub. Date: Jul. 5, 2001

(65) Prior Publication Data

US 2003/0052017 A1 Mar. 20, 2003

(30) Foreign Application Priority Data

Dec. 23, 1999 (DE) ..... 199 62 897

(51) Int. Cl.[7] ..... B65D 85/00

(52) U.S. Cl. ..... 206/1.7; 206/558; 206/559; 220/527

(58) Field of Search ..... 206/558, 1.7–1.9, 206/81, 559, 759; 211/80, 81; 220/527

(56) References Cited

U.S. PATENT DOCUMENTS 4,765,457 A * 8/1988 Rayhle ..... 206/1.8

FOREIGN PATENT DOCUMENTS

| | | |
|---|---|---|
| DE | 70 06 998 | 6/1970 |
| DE | 71 25 446 | 9/1971 |
| DE | 41 42 233 | 3/1993 |

* cited by examiner

*Primary Examiner*—Jimmy G Foster
(74) *Attorney, Agent, or Firm*—Arent Fox

(57) ABSTRACT

The invention is directed to a paint box (1) with replaceable color pans (6), having at the bottom of the paint box (1) a holding rail (4) which engages in a downwardly open groove (17) formed on the underside of a protruding rim (15) of the color pans (6), said rail forming a swivel bearing with a swivel axis parallel to the box bottom (2). The groove (17) has a cross section widening in downward direction and the color pans (6) rest loosely on the holding rail (4). Furthermore, on the side of the holding rail (4) close to the color pans (6) provision is made for holding elements (7, 8) extending up from the box bottom (2) and enabling the individual color pans (6) to be securely fixed by frictional engagement with the box bottom (2). Provision is made for a respective push-button (16) on the protruding rim (15) of the color pans (6) on the side of the holding rail (4) remote from the color pans (6). By pressing down the push-button (16) of a color pan (6) this particular color pan is adapted to be swiveled about the swivel axis and disengageable from the holding elements (7 and 8).

11 Claims, 2 Drawing Sheets

PAINTBOX COMPRISING EXCHANGEABLE PAINT DISHES

This invention relates to a paint box with replaceable color pans, including cooperating holding elements provided on the bottom of the paint box and on the side of the color pans, which holding elements serve to removably retain the color pans in the paint box in an aligned position, and further including a holding rail at the bottom of the paint box, which rail engages in a downwardly open groove formed on the underside of a protruding rim of the color pans, said rail forming a swivel bearing with a swivel axis parallel to the bottom of the box.

In a paint box of the type referred to which is known from German Utility Model DE-GM 70 06 998, the holding rail has at its upper edge a thickened bead engaging with a snap action in an undercut groove on the underside of the protruding rim of the color pans when the color pans are inserted in the paint box and pressed against the holding rail. In the longitudinal direction of the holding rail the position of the color pans is determined by spacer knobs provided on the holding rail. To disengage the color pans from the holding rail the pan rim projecting beyond the holding rail may be pressed down with the finger of a user's hand. This causes the corresponding color pan to be swung upward by rotating about the bead of the holding rail until the pan rim on the side remote from the holding rail can be gripped from underneath, enabling the pan to be detached from the holding rail using an upward pulling motion. The disadvantage of this known paint box design is that the color pans are not fixedly securable in the paint box since they are allowed to execute a limited swiveling motion about the fastening bead of the holding rail. This may result in rattling noise during transport of the paint box. Furthermore, the clamping of the color pans to the bead of the holding rail depends to a large extent on manufacturing tolerances, with the result that given an adverse tolerance situation either the forces for pressing on and detaching the color pans may be too high or the resistance against accidental detachment may be too low.

From German Utility Model DE-GM 71 25 446 a paint box is known having color pans which include a protruding rim of a rectangular outer contour and are held on a holding rail with spacer knobs.

It is an object of the present invention to improve the fastening of the color pans of a paint box of the type referred to in terms of handling and reduce the dependence on manufacturing tolerances.

According to the present invention this object is accomplished in that the groove on the underside of the protruding rim of the color pans has a cross section widening in downward direction, that on the side of the holding rail close to the color pans provision is made for holding elements extending up from the box bottom and enabling the individual color pans to be securely fixed by frictional engagement with the box bottom, that provision is made for a respective push-button on the protruding rim of the color pans on the side of the holding rail remote from the color pans, and that by pressing down the push-button of a color pan this particular color pan is adapted to be swiveled about the swivel axis and disengageable from the holding elements.

In the paint box of the present invention the elements for holding the color pans in the paint box by frictional engagement are spatially separated from the swivel bearing on the holding rail. This enables the holding elements provided for holding to be designed substantially more favorably, as by providing them with a greater spring deflection, whereby the dependence on manufacturing-related dimensional tolerances may be reduced significantly. Excessively high or low holding forces are therefore easily avoidable. The provision of push-buttons on the color pans simplifies the removal of the color pans, because the color pans are already disengaged from the holding elements by operating the push-buttons and are then readily removable from the paint box without the need to overcome a resistance. The operations of disengaging and removing the color pans may be performed with a single hand because, following disengagement of the color pan and letting go of the push-button, the color pan remains in a raised position, enabling it to be gripped with the same hand. In addition, by suitably designing the push-button it is possible to limit the swiveling angle of the color pans during their removal to such an extent that dissolved pigment is prevented from flowing out of the pans. The paint box of the invention has the added advantage that the color pans are held in engagement with the box bottom by the holding elements also when the box is turned upside down, and therefore do not rattle during transport of the paint box, regardless of the position. Finally, it is also possible to load the paint box of the invention with color pans of known construction by retaining the holding rail and appropriate positioning of the holding elements, this however at the expense of the advantages achievable with the configuration of the invention.

According to a further proposal of the invention the push-button extends across the full width of the color pan and is inclined at an angle of in particular 60° relative to the plane of the box bottom. As a result, the push-buttons of the adjacent color pans form a smooth, closed surface area bounding the adjoining box space serving as a brush tray, for example, in an esthetically pleasing manner. Adjoining the lower end of the push-buttons may be a rib provided on the box bottom, which rib closes a space formed between the push-buttons and the box bottom. To limit the swiveling angle of the push-buttons provision may be furthermore made for a stop rib on the box bottom which projects into the range of movement of the push-buttons.

The protruding rim of the color pans may furthermore have a rectangular outer contour with edges parallel to the side walls of the paint box, so that the adjacent color pans form with their upper side a closed surface area having adjacent recesses to receive the color tablets.

According to the invention, for each color pan there may be provided as holding elements one pair of thin-walled elastically deformable ribs which are spaced from each other in an arrangement contiguous to the holding rail and essentially perpendicular to the holding rail and the box bottom and have on their sides remote from or close to each other at their upper edge a projection on which a color pan is securable. According to the invention the color pans have on their protruding rim downwardly extending lugs which are adjacent to the ribs and aligned parallel to said ribs and carry on their sides remote from or close to each other a projection bearing against the projection of the ribs with the color pans in the holding position.

The present invention will be explained in more detail in the following with reference to an embodiment illustrated in the accompanying drawings. In the drawings, FIG. 1 is a perspective view of a portion of a paint box of the invention without color pans;

Figure 1:
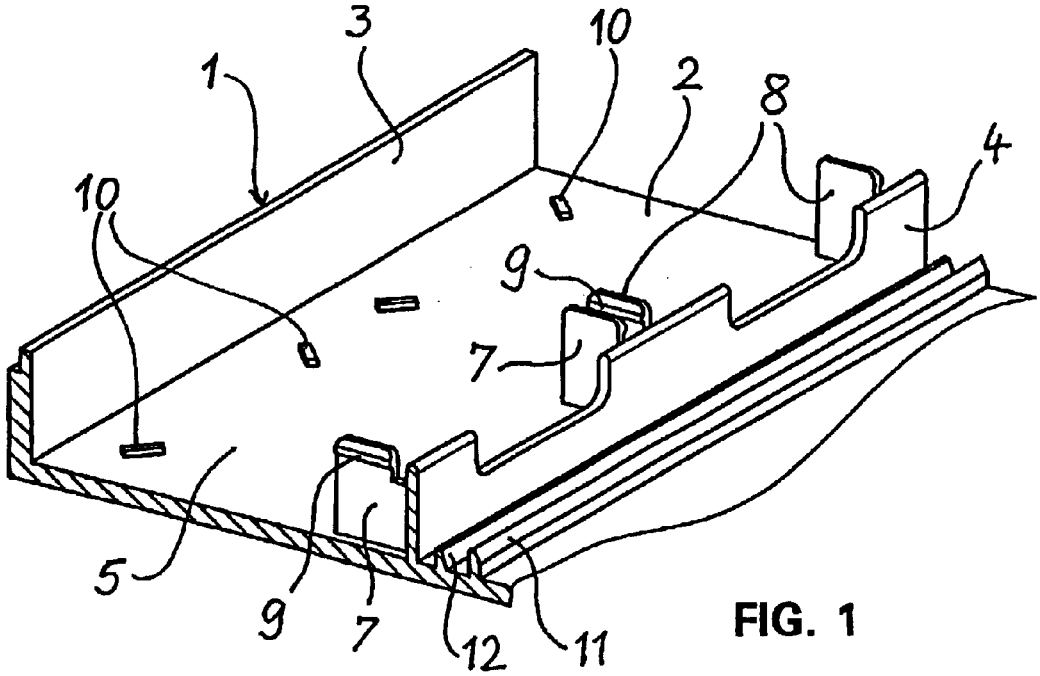

The paint box 1 shown includes a box bottom 2 and a side wall 3 encompassing the box bottom 2 on four sides in conventional manner. Arranged at a distance from the side wall 3 and parallel thereto is a holding rail 4 standing on the box bottom 2 perpendicularly. The space 5 between the side wall 3 and the holding rail 4 serves to accommodate color pans 6. Arranged in the space 5 contiguous to the holding rail 4 are spaced-apart holding elements 7, 8 constructed as ribs extending vertically to the box bottom 2 and the holding rail 5. Each two holding elements 7 and 8 arranged at a larger relative distance form a pair which cooperates to retain a color pan 6. The holding elements 7 and 8 of each pair have at the upper edge on their sides facing away from each other a lateral projection 9 in the manner of a rib extending parallel to the box bottom 2. Proximate the side wall 3 the box bottom 2 has right parallelepipedal elevations 10 on which the color pans 6 rest. Provided on the side remote from the holding elements 7, 8 parallel to the holding rail 4 are a rib 11 and a stop rib 12 of low height compared to the holding rail 4.

The color pans 6 have the form of a shallow, hollow circular cylinder with a plane bottom 13 and an opening enlarged by a frusto-conical upper collar 14 merging into a laterally protruding rim 15 of a rectangular outer contour. Integrally formed on one side of the rim 15 is a rectangular, plane push-button 16 which has the same width as the rim 15. The push-button 16 is inclined in the direction of the plane of the rim 15, enclosing with it an angle of 120°. Provided on the underside of the rim 15 directly adjacent to the push-button 16 and parallel thereto is a groove 17 whose cross section widens in downward direction and which receives the holding rail 4 when the color pan 6 is inserted in the paint box 1, forming in combination with the holding rail a swivel bearing. At the two outer edges of the protruding rim 15 perpendicular to the groove 17, plate-shaped lugs 18 are formed contiguous to the groove 17 and extending downwardly normal to the plane of the rim 15. On their inner side close to the circular cylinder the lugs 18 have each a projection 19 at their lower edge and at a distance to the groove 17. The relative distance of the facing inner surfaces of the lugs 18 is essentially equal to the relative distance of the facing outer surfaces of one pair of holding elements 7 and 8.

Figure 2:
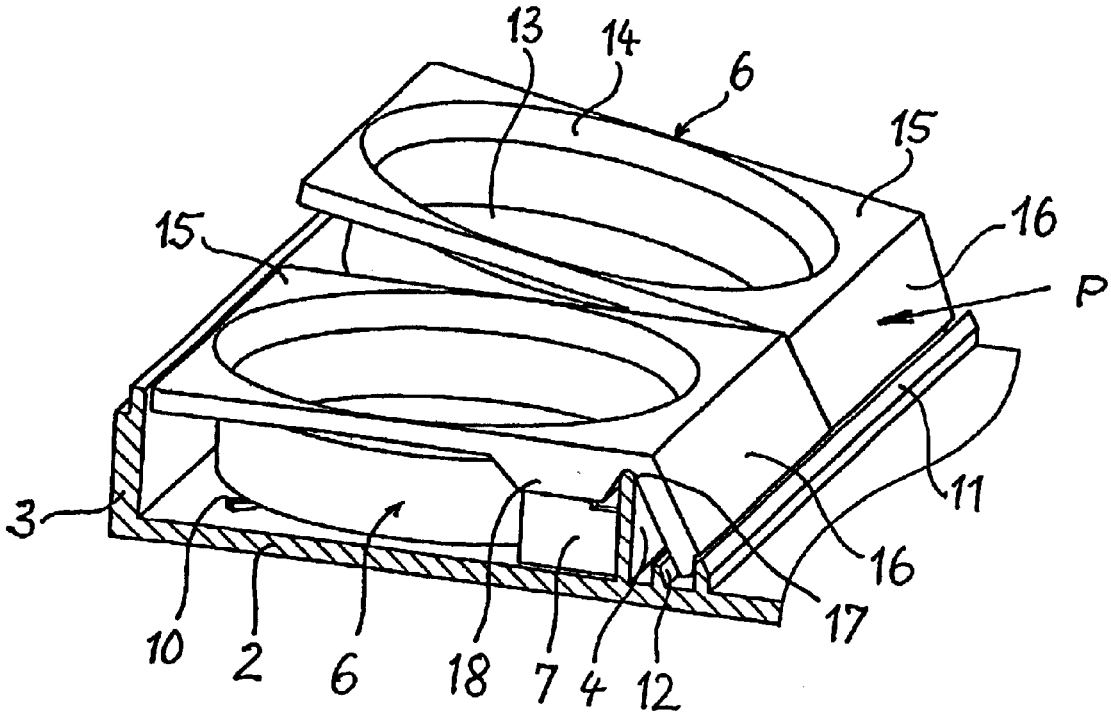
FIG. 2 is a perspective view of a portion of the paint box of the invention according to FIG. 2 with two color pans.
Figure 3:
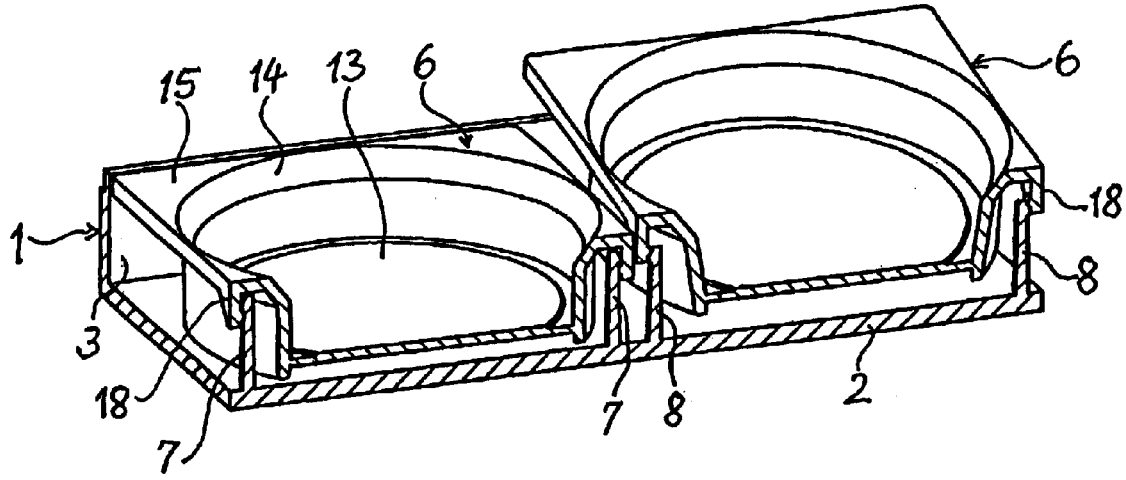
FIG. 3 is another perspective view of the portion of FIG. 2, sectioned in the longitudinal direction in the area of the holding elements.
Figure 4:
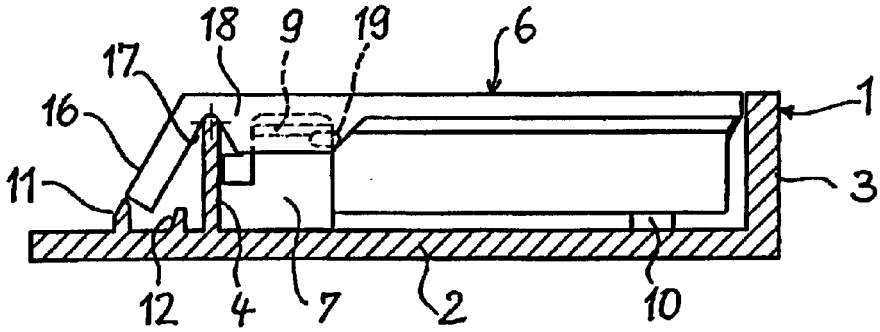
FIG. 4 is a cross sectional view of the portion of FIG. 2 showing a color pan inserted.

When a color pan 6 is inserted in the paint box 1, its bottom edge makes initial contact with the elevations 10, and its projections 19 on the lugs 18 make contact with the projections 9 on the holding elements 7 or 8. By exerting a slight pressure on the color pan 6 the projections 19 slide over and beyond the projections 9, with the holding elements receding resiliently towards the middle as this occurs. As soon as the color pan 6 rests firmly on the holding rail 4 with its groove 17, the holding elements 7 or 8 spring back to their initial position, with the projections 9 embracing the projections 19 from above, thereby securely holding the color pan 6 in the reached position on the paint box. This position of the color pan 6 is shown in FIGS. 2 and 3 for the front and, respectively, left-hand color pan as well as in FIG. 4. Considering that the contact points of the projections 9 and 19 are between the holding rail 4 and the elevations 10 and at a distance from these, secure fixing of the color pan in the paint box is assured also with relatively low clamping forces.

When it is desired to remove a color pan 6 from the paint box 1, the push-button 16 of the color pan 6 is pressed down in the direction of the arrow P until its abutment with the stop rib 12. In this process the color pan 6 is swung upwards, with the projections 19 sliding over and beyond the projections 9, thereby disengaging the color pan 6 from the holding elements 7 or 8.

Figure 5:
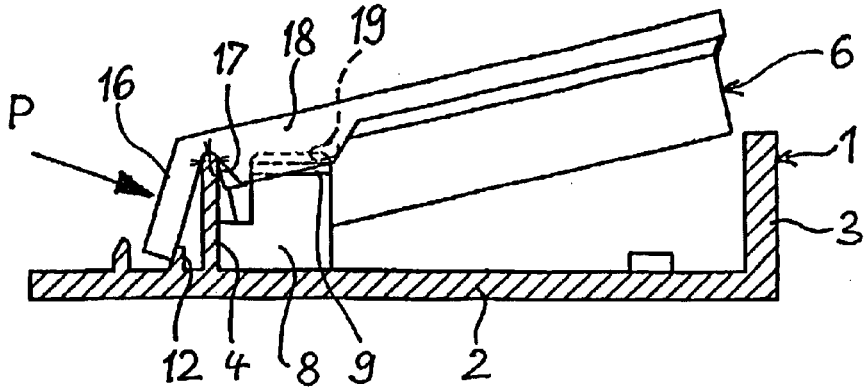
FIG. 5 is a cross sectional view of the portion of FIG. 2 showing the color pan disengaged.

The disengaged position thus attained is shown for the rear and right-hand color pan 6 in FIGS. 2 and 3, respectively, and in FIG. 5. To remove the color pan 6 it may then be gripped by the raised part of the rim 15 with the push-button 16 pressed down. Alternatively, however, it is also possible to let go of the push-button 16 again. In this case the color pan 6 turns about the projections 19 resting on the projections 9, with the end of the color pan 6 on the side remote from the push-button 12 moving back into the paint box 1 while instead the end of the color pan 6 on the side close to the push-button is lifted an amount enabling the color pan 6 to be gripped for removal from the paint box.

Apart from the example described, a number of other configurations of the paint box of the invention are also possible. For instance, the holding elements of the paint box may embrace the collars on the color pans from outside. On the other hand, the holding elements may also be configured in such manner that they engage directly the cylindrical part of the color pans or lugs provided on the underside of the color pans. It is not necessary for the pans to be round, they may also be of a rectangular or polygonal configuration.

What is claimed is:

1. A paint box with replaceable color pans, including cooperating holding elements provided on the bottom of the paint box and on the side of the color pans, which holding elements serve to removably retain the color pans in the paint box in an aligned position, and further including a holding rail at the bottom of the paint box, which rail engages in a downwardly open groove formed on the underside of a protruding rim of the color pans, said rail forming a swivel bearing with a swivel axis parallel to the box bottom, characterized in that the groove has a cross section widening in downward direction and the color pans rest loosely on the holding rail, that on the side of the holding rail close to the color pans provision is made for the holding elements extending up from the box bottom and enabling the individual color pans to be securely fixed by frictional engagement with the box bottom, that provision is made for a respective push-button on the protruding rim of the color pans on the side of the holding rail remote from the color pans and at a distance therefrom, and that by pressing down the push-button of a color pan this particular color pan is adapted to be swiveled about the swivel axis and disengageable from the holding elements.

2. The paint box according to claim 1, characterized in that the push-button extends across the full width of the color pan and is inclined at an angle to the plane of the box bottom.

3. The paint box according to any one of the claims 1 or 2, characterized in that the lower end of the push-button remote from the color pan adjoins an upstanding rib provided on the box bottom.

4. The paint box according to claim 1, characterized in that provision is made for a stop rib on the box bottom, which rib projects into the range of movement of the push-button and limits the swivel angle of the push-button.

5. The paint box according to claim 1, characterized in that the protruding rim of the color pans has a rectangular outer contour with edges parallel to the swivel axis of the swivel bearing and to the side walls of the paint box, and that the adjacent color pans form with their upper side a closed surface area having adjacent recesses to receive the color tablets.

6. The paint box according to claim 1, characterized in that the holding elements for a single color pan are comprised of a pair of thin-walled elastically deformable ribs which are spaced from each other in an arrangement proximate the holding rail and essentially perpendicular to the holding rail and the box bottom and have on their sides remote from or close to each other a projection on which the color pan is securable.

7. The paint box according to claim 1, characterized in that the color pans have on their protruding rim downwardly extending lugs which carry on their sides remote from or close to each other projections bearing against the projections of the holding elements with the color pan in the holding position in the paint box.

8. A color pan for use in a paint box, the color pan comprising: a protruding rim, a groove formed on the underside of the protruding rim and having a cross section widening in downward direction, a push-button provided on the protruding rim and located on a side of the groove remote from the color pan, and a pair of downwardly extending lugs provided on the protruding rim, which lugs are located on the side of the groove close to the color pan and carry projections on their sides close to or remote from each other wherein the paint box includes cooperating holding elements provided on the bottom of the paint box, which holding elements serve to removably retain the color pan in the paint box in an aligned position, and a holding rail at the bottom of the paint box, which rail engages in the downwardly open groove formed on the underside of a protruding rim of the color pan, said rail forming a swivel bearing with a swivel axis parallel to the box bottom, wherein the groove has a cross section widening in downward direction and the color pan rests loosely on the holding rail, the holding elements extend up from the box bottom on the side of the holding rail close to the color pan and enable the color pan to be securely fixed by frictional engagement with the box bottom, the push-button provided on the protruding rim of the color pan on the side of the holding rail remote from the color pan and at a distance therefrom, is positioned so that by pressing down the push-button of the color pan the color pan is adapted to be swiveled about the swivel axis and disengageable from the holding elements.

9. The color pan according to claim 8, characterized in that the push-button extends across the full width of the color pan and is inclined towards the protruding rim.

10. A color pan for use in a paint box, the color pan comprising a protruding rim, a groove formed on the underside of the protruding rim and having a cross section widening in downward direction, a push-button provided on the protruding rim and located on a side of the groove remote from the color pan, and a pair of downwardly extending lugs provided on the protruding rim, which lugs are located on the side of the groove close to the color pan and carry projections on their sides close to or remote from each other.

11. The color pan according to claim 10, wherein the push-button extends across the full width of the color pan and is inclined towards the protruding rim.

* * * * *